United States Patent [19]

Grennan

[11] 4,213,735

[45] Jul. 22, 1980

[54] CONSTANT FLOW CENTRIFUGAL PUMP

[75] Inventor: Charles W. Grennan, Newington, Conn.

[73] Assignee: Chandler Evans Inc., West Hartford, Conn.

[21] Appl. No.: 8,236

[22] Filed: Feb. 1, 1979

[51] Int. Cl.[3] ..... F04D 15/00; F01D 5/02; F03B 15/02

[52] U.S. Cl. ..... 415/21; 415/26; 415/131; 415/140

[58] Field of Search ..... 415/21, 26, 34, 129, 415/131, 140, 141, 143

[56] References Cited

U.S. PATENT DOCUMENTS

| | | | |
|---|---|---|---|
| 180,612 | 8/1876 | Marlin | 415/131 |
| 2,358,744 | 9/1944 | Stepanoff | 415/131 X |
| 3,407,740 | 10/1968 | Samerdyke | 415/131 |
| 3,733,143 | 5/1973 | Theis, Jr. | 415/141 X |
| 3,918,831 | 11/1975 | Grennan | 415/131 |

*Primary Examiner*—Stanley N. Gilreath
*Attorney, Agent, or Firm*—Radford W. Luther; Richard A. Dornon

[57] ABSTRACT

A high pressure centrifugal pump has an impeller assembly including two mating impeller sections which are each constituted by a shroud with fixed geometry blades. The impeller sections are fixedly mounted upon a rotatable shaft and are of a construction which permits the pressure between the impeller sections to engender flexure of the sections away from each other so as to vary the breadth of the impeller assembly. A servo control device is adapted to control the pressure behind the shrouds such that the pump delivers a constant flow at varying back pressures.

4 Claims, 6 Drawing Figures

CONSTANT FLOW CENTRIFUGAL PUMP

BACKGROUND OF THE INVENTION

This invention relates to pumps, and more particularly to constant flow centrifugal pumps.

U.S. Pat. No. 3,918,831 discloses a constant flow centrifugal pump having two telescoping mirror image impeller sections urged together by a tension spring which additionally functions as an inducer. While the pump shown in the aforementioned patent can effectively vary its geometry in response to back pressure variations to provide a constant flow rate, there is an obvious problem associated with the design of the spring for applications involving extremely high pressure (e.g., 1000 psi) in which the spring must be extremely powerful.

SUMMARY OF THE INVENTION

The invention provides a pump similar to that illustrated in the aforementioned patent, but which utilizes the flexure of the shrouds to generate the necessary spring force for extreme high pressure applications. In addition, a servo control device responsive to the flow rate is incorporated in the pump to vary the pressure on the back of the shrouds, which act similar to belleville springs, so that the flow rate may be precisely controlled. In a pump of the invention, the hubs of the shrouds are mounted in the pump housing so as to always be in fixed axial relationship when the pump is running.

Accordingly, it is a primary object of the invention to provide a high pressure centrifugal pump adapted to deliver a substantially constant flow under varying backpressure conditions.

Another object is to provide a constant flow centrifugal pump having an impeller whose geometry can be varied by flexure of at least one shroud.

A further object is to provide a high pressure, constant flow centrifugal pump having an impeller assembly formed by two mating impeller sections wherein the shrouds of the impeller sections are adapted to flex toward and away from each other in response to back pressure variations so as to vary the breadth of the impeller assembly and hence the rate of flow.

These and other objects and advantages of the invention will become more readily apparent from the following detailed description, when taken in conjunction with the accompanying drawings, in which:

DETAILED DESCRIPTION OF PREFERRED EMBODIMENT

Figure 1:
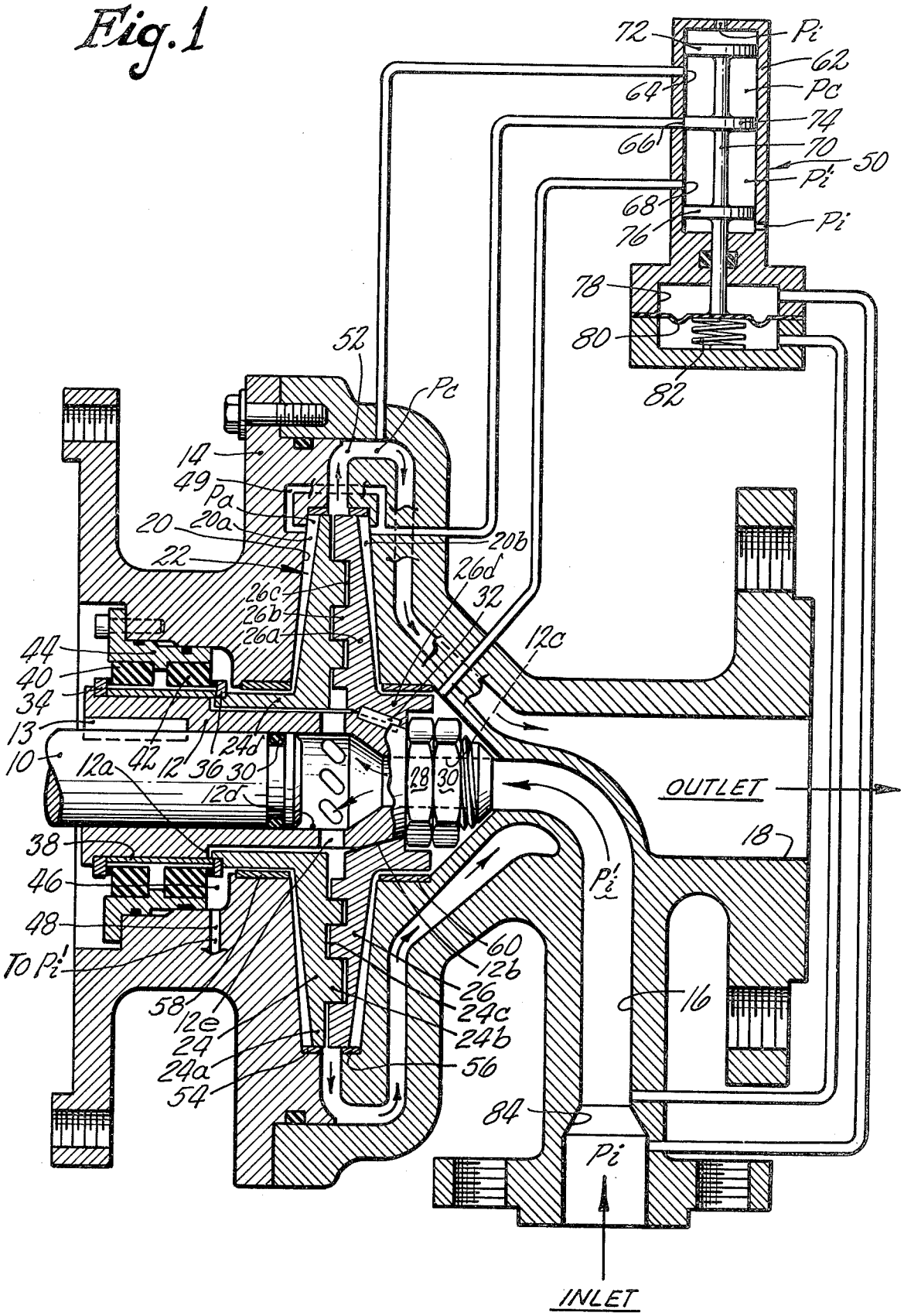
FIG. 1 is a longitudinal sectional view of a centrifugal pump of the invention shown in schematic association with a servo control device.

Referring to FIG. 1, there is shown an embodiment of a pump of the invention adapted to supply a substantially constant output flow under varying back pressures which may be relatively high. A main drive shaft 10, which is mounted in suitable bearings (not shown), is in driving engagement with a pump drive shaft 12 by virtue of a key 13 positioned in respective confronting slots in the drive shafts 10 and 12. The drive shaft assembly, formed by the drive shafts 10 and 12, is mounted in a pump housing 14. The pump housing 14 comprises an inlet conduit 16 and an outlet conduit 18 which fluidly communicate with a pumping cavity 20 therein.

Mounted upon the drive shaft 12 for rotation therewith is an impeller assembly, generally indicated at 22, which comprises a first impeller section 24 and a second impeller section 26 in telescoping relationship with the first. Impeller section 24 is constituted by a shroud **24*a* having a plurality of vanes 24*b* formed thereupon with channels or slots 24*c* defined therebetween. The thickness of the shroud 24*a* progressively decreases in a radially outward direction to allow for proper shroud flexure and to maintain an adequate clearance from the walls of the cavity 20. Impeller section 26 embodies a similar shroud 26*a* and similar vanes 26*b* and channels or slots 26*c*. As shown in FIG. 1**, the impeller sections are in such telescoping relationship that flexure of the shrouds will vary the flow area (exposed vane area) of the impeller assembly.

The respective hub portions **24*d* and 26*d* of the impeller sections 24 and 26 are mounted upon the pump drive shaft 12 such that, with the exception of flexing of the shrouds 24*a* and 26*a*, the impeller sections 24 and 26 are in fixed axial relationship to the drive shaft 12. The left end of the hub portion 24*d* bears against a shoulder 12*a* on the drive shaft 12. The interior wall of the hub portion 26*d* is contoured to be urged against a conical surface 12*b* of the drive shaft 12. A locking ring 28 and a lock nut 30, in tandem relationship therewith, serve to secure the impeller assembly 22 to the drive shaft 12. A key 32, received in confronting slots in the shaft 12 and the hub 26*d* transmits torque from the drive shaft 12 to the impeller section 26 for imparting rotation thereto. Rotation is imparted to the impeller section 24 by the vanes 26*b* of the impeller section 26; and, hence, impeller sections 26 and 24** may be respectively regarded as a driver impeller and a driven impeller.

Flow enters an inlet passage **12*c* in the drive shaft 12 and proceeds thence to an enlarged diameter passage 12*d*. A plurality of radial inlet ports 12*e* extending through the shaft 12 conduct fluid from the passage 12*d* to the entrances of the flow channels adjacent the eye of the impeller assembly 22. The provision of an 0-ring seal 30 in an annular groove on the main drive shaft 10 prevents leakage of inlet fluid between the drive shafts 10 and 12**.

The drive shaft 12 and the impeller hub **24*d* carry respective seal faces 34 and 36 which are urged against shoulders on the drive shaft 12 and the hub 24*d* by a spacer 38 interposed therebetween. Carbon faced seals 40 and 42, mounted on a seal retainer 44, are in respective wiping engagement with the seal faces 34 and 36 to further seal the rear of the pump housing 14. The annular volume 46 adjacent carbon faced seal 42 and seal face 36 is referenced to inlet pressure P'i by a conduit 48** to minimize the pressure to which the sealing structure is exposed.

The pressure Pa in the pumping cavity 20, which is the same behind each shroud by virtue of an interconnecting passage 49, is preferably modulated in such a manner that a constant output flow is substantially maintained over a wide range of back pressures. The pressure to which the backs of the shrouds are subjected is, of course, determinative of the flexure of the shrouds and, hence, the flow area of the impeller assembly 22 for a given discharge pressure. A flow responsive servo valve, such as generally shown at 50, is ideally suited for such an application as will be more fully explained hereinafter. Of course, it will be appreciated by those skilled in the art that servo control may be dispensed with entirely if precise flow control is unnecessary for the application selected for the pump.

The impeller assembly 22 discharges flow from pumping cavity 20 into an annular collector 52 formed in the housing 14. Such flow may be discharged into the collector 52 via a diffuser if desired. The circumferential periphery of the impeller assembly 22 is then exposed to a discharge pressure Pc. Seal rings 54 and 56 are respectively affixed to the housing adjacent the outer peripheries of the shrouds 24 and 26. Additional seal rings 58 and 60 are respectively affixed to the housing 14 adjacent the outer peripheries of the hubs **24*d* and 26*d*. The seal rings 54 and 56 function to define two supply orifices in parallel flow relationship which both communicate with the chambers 20*a* and 20*b* formed by the shrouds and the walls of cavity 20 adjacent thereto. In like manner, the seal rings 58 and 60 function to define two drain orifices in parallel flow relationship which both communicate with the chambers and with the inlet conduit 16. By proper sizing of the fixed orifices formed by the seals 54, 56, 58, and 60, the pressure Pa may be caused to assume a desired intermediate value between discharge pressure and inlet pressure in the absence of any influence by the servo control valve 50**.

Servo control valve 50 comprises a housing 62 incorporating three control ports 64, 66, and 68. A spool 70, slideable within the housing 62 has three lands 72, 74, and 76. The design of the valve 50 is such that the pressure Pc is always maintained between the lands 72 and 74 and the pressure P'i is always maintained between the lands 74 and 76, irrespective of the position of spool 70 relative to housing 62. The land 74, which normally covers port 66 at design flow, may be positioned to provide a variable area orifice supplied with either the pressure Pc or the pressure P'i. From FIG. 1, it will be seen that port 66 communicates with the chambers **20*a* and 20*b* and that the pressure therein may be modulated by positioning spool 70**.

The spool 70 is received within a lower cavity 78 wherein it is connected to a diaphragm 80 which divides cavity 78 and is spring urged upwardly by compression spring 82. The diaphragm 80 is appropriately secured to the wall of the cavity 78 so as to seal the upper portion thereof from the lower portion thereof. The upper and lower surfaces of the diaphragm 80 are respectively exposed to the pressure upstream and downstream of a converging section 84 of inlet conduit 16. The pressure differential across the diaphragm 80 is, of course, indicative of the rate of flow through the pump. It will be noted that an increase in flow will tend to drive the spool 70 downwardly while a decrease in flow will drive the spool 70 upwardly. Upward displacement of the land 66 will, of course, open another flow path from the chambers **20*a* and 20*b* to inlet pressure P'i. Similarly, downward displacement of spool 66 will open another flow path from the collector 52 to the chambers 20*a* and 20*b*. Obviously, movement in either direction of the spool 70 will cease when the originally imposed differential pressure across diaphragm 80 is restored whereby the load of spring 82** is balanced.

Figure 2:
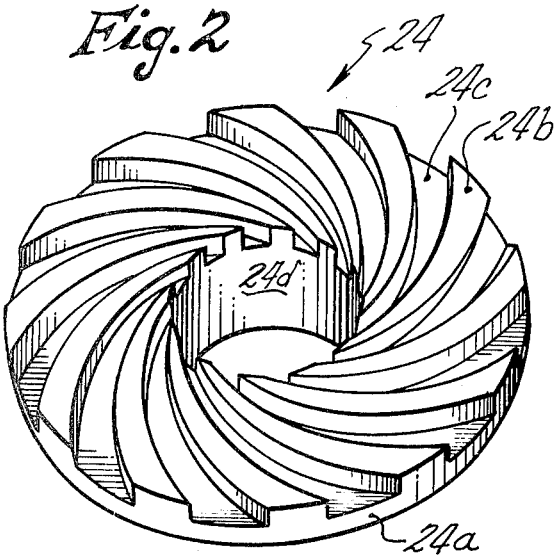
FIGS. 2 and 3 are perspective views of the impeller sections showing the mirror image vaned faces thereof.
Figure 3:
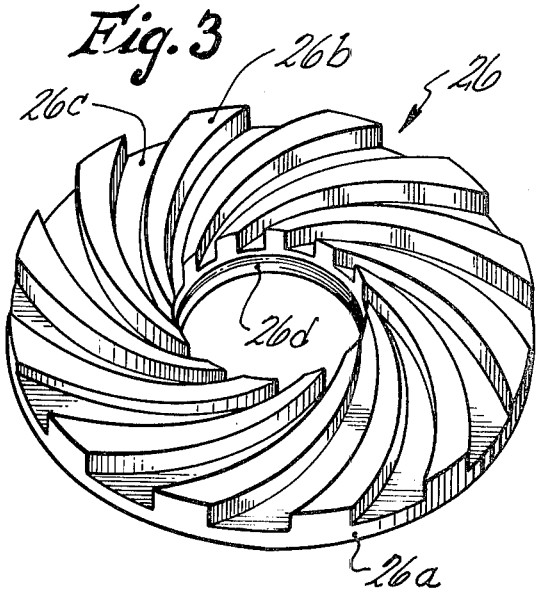

Turning to FIGS. 2 and 3, the geometry of the impeller sections 24 and 26 is made evident. As previously mentioned, the respective inboard vaned faces of the impeller sections 24 and 26 are telescopingly related. To this end, the vaned face of the impeller section 24 is the mirror image of the vaned face of the other section 26. Of course, the converse is also true. It will be noted that the curved flow channels or slots and curved vanes of each impeller section are of constant arc from the inlet end (inner circumferential periphery) to the outlet end (outer circumferential periphery). The vanes and flow channels also progressively increase in width from the inlet end to the outlet end. The vanes of one impeller section are preferably sized to make a close sliding fit with the flow channels of the other impeller sections consonant with the maximum extent of shroud flexing and accurate manufacture. It should, however, be noted that if the flow channels are significantly larger than the vanes received therein, pump operation will continue but the extent of control will be limited.

Figure 4:
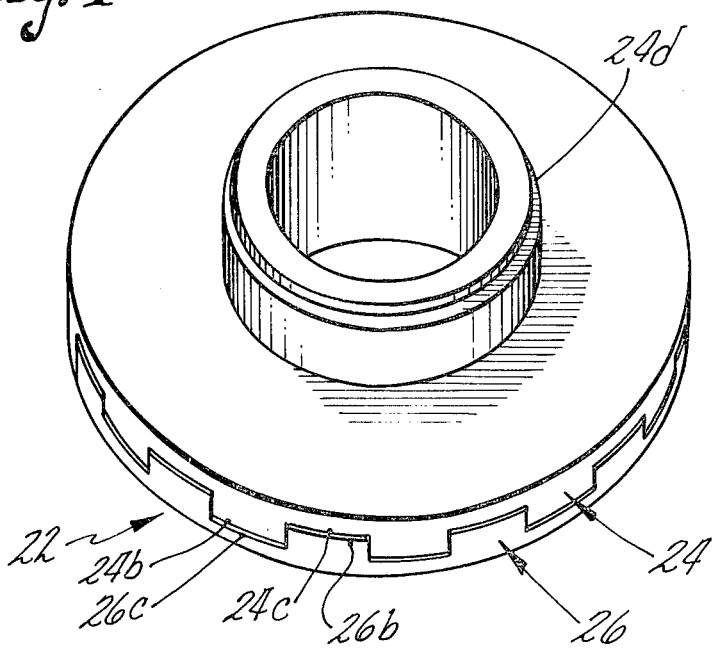
FIG. 4 is a perspective view of the impeller assembly.

FIG. 4 shows the impeller sections 24 and 26 in telescopic engagement at minimum flow position with no flexing. From FIG. 4, it can be appreciated that the rotating impeller assembly 22 avoids generating output pressure pulsations since every circumferential station around the periphery thereof is encompassed by a flow channel discharge area. In addition, the depicted impeller assembly design approaches an optimum hydraulic radius so as to engender minimum friction loss. Since the illustrated collector 52 possesses no-cut water or tongue, it will not, in and of itself, produce pressure pulsations.

Figure 5:
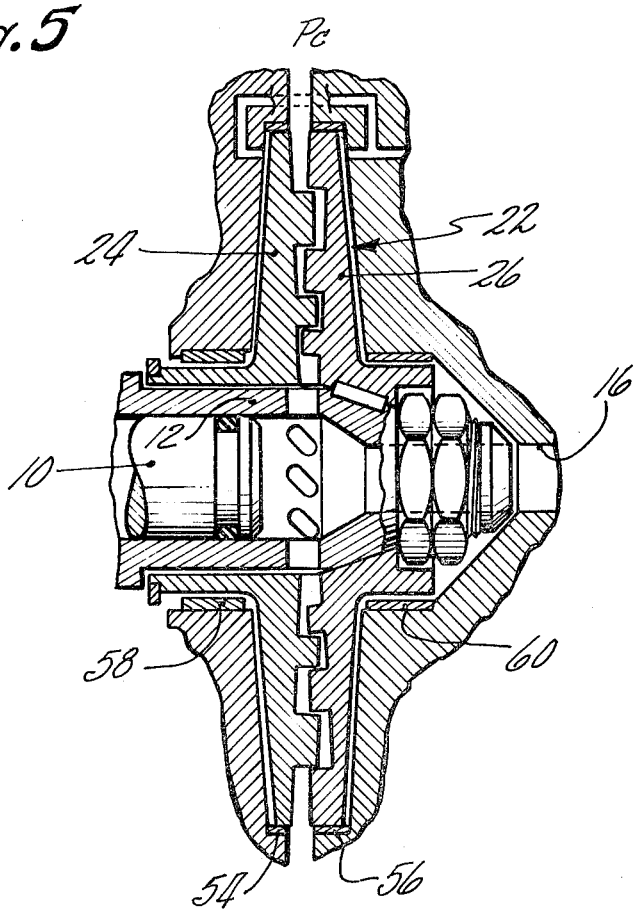
FIG. 5 is an exaggerated sectional view of the impeller assembly after substantial flexure of the respective shrouds in the impeller assembly.

During operation, the pressure within the impeller assembly 22 will act to urge flexure of the shrouds **24*a* and 26*a*. Since the back pressure Pc in the collector 52 is determinative of this pressure, the breadth of the impeller is directly responsive to the back pressure. A substantial flexing of the shrouds is illustrated in FIG. 5**.

Figure 6:
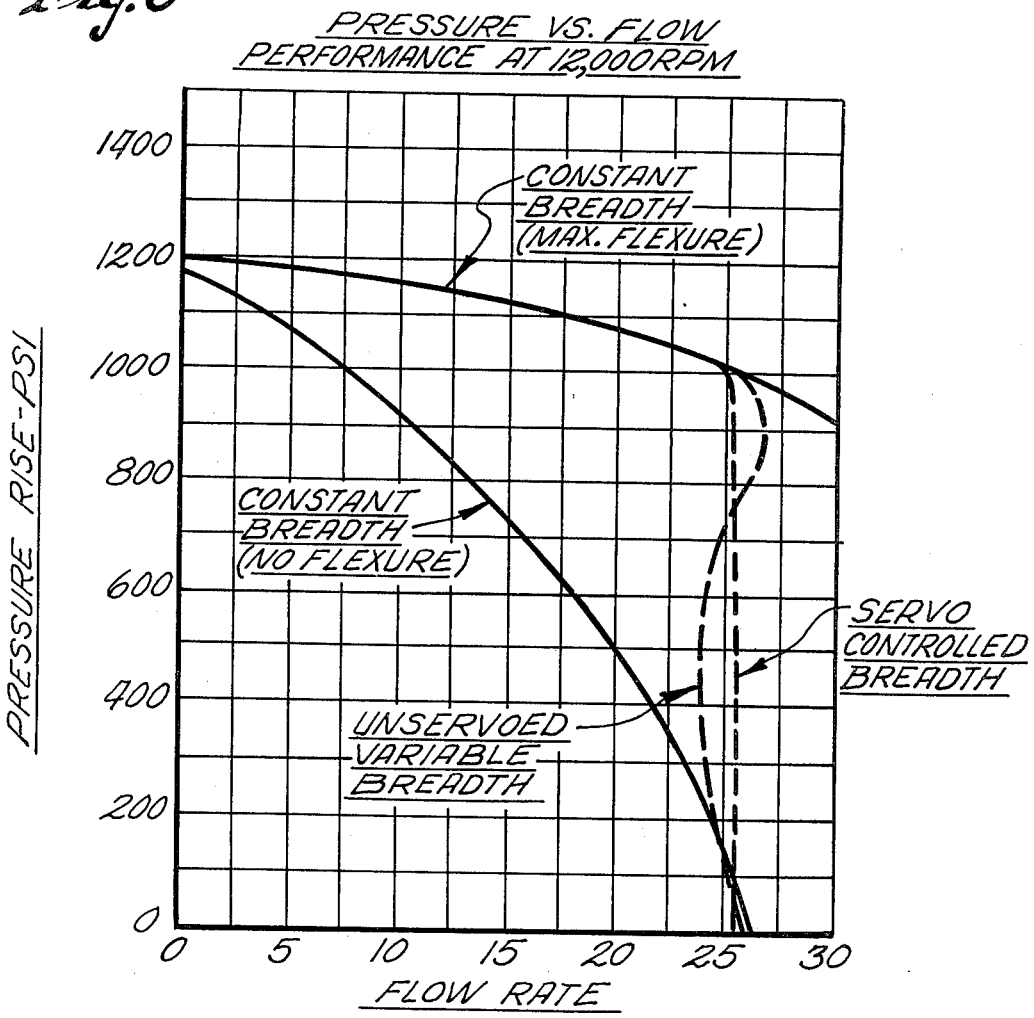
FIG. 6 is a graph depicting the relationship between flow rate and pressure for two pumps of the invention.

Any impeller will produce a flow rate (Q) directly proportional to the blade or passage area (S) and peripheral speed (V) and inversely proportional to back pressure (P). This relationship may be expressed by the following equation:

$$Q=KV^2S/P$$

wherein: K is a constant. In a pump of the invention, as with the pump of the previously noted patent, the value of (S/P) remains substantially constant (because of the flexing shrouds in the present instance). Hence, for a given RPM, pump output flow will be generally constant as shown in the unservoed variable breadth curve of FIG. 6.

It will be understood that the invention can be practiced with only one impeller having its vanes received within slots in a disc, such as shown, for example, in FIG. 1 of British Pat. No. 326,909, although the illustrated design is preferable.

Obviously, many modifications and variations are possible in light of the above teachings without departing from the scope or spirit of the invention as set forth in the appended claims.

I claim:

1. In an improved variable geometry impeller pump adapted to provide a constant output flow under varying back pressure of the type comprising: a pump housing having an inlet conduit, an outlet conduit, a pumping cavity and a collector, the inlet conduit being in fluid communication with the pumping cavity and the collector being in fluid communication with the pumping cavity and the outlet conduit, an impeller section mounted for rotation in the housing for impelling fluid into the collector, the impeller section having a hub and a plurality of vanes with first slots defined therebetween, a structure mounted for rotation in the housing, the structure having a hub and a plurality of second slots in which the vanes of the impeller section are received, the improvement comprising:

a shroud connected to the hub of the impeller section and carrying the vanes, the shroud being of such a thickness as to be flexible in the manner of a Belleville spring and forming a chamber with the wall of the pumping cavity adjacent thereto;

means for mounting the hubs of the impeller section and the structure in fixed axial relationship with respect to each other, whereby flexing of the shroud functions to vary the exposed area of the vanes;

supply orifice means to provide a fluid resistance to communication between the collector and the chamber; and drain orifice means to provide a fluid resistance to communication between the chamber and the inlet conduit.

2. The improvement of claim 1, further comprising:

servo control means responsive to the flow rate through the pump for modulating the pressure in the chamber so as to maintain a substantially constant flow rate.

3. The improvement of claim 2, wherein the servo control means comprises:

a servo valve in fluid connection with the chamber, the collector and the inlet conduit for providing a variable fluid resistance to fluid communication between the collector and the chamber and to communication between the chamber and the inlet conduit; and means responsive to the rate of flow through the pump for positioning the valve.

4. The improvement of claim 1, wherein the pump is of the type in which the structure comprises another impeller section having a plurality of vanes with the second slots formed therebetween, the vanes of the second mentioned impeller section being received in the first slots and wherein the improvement further comprises:

a shroud connected to the hub of the second mentioned impeller section and carrying the vanes of the second mentioned impeller section, the second mentioned shroud being of such a thickness as to be flexible in the manner of a Belleville spring and forming a chamber with the wall of the cavity adjacent thereto;

supply orifice means to provide a fluid resistance to communication between the collector and the second mentioned chamber;

drain orifice means to provide a fluid resistance to communication between the second mentioned chamber and the inlet conduit; and means to fluidly interconnect the first mentioned and second mentioned chambers for equalizing the pressures therein.

* * * * *